US010519401B2

(12) United States Patent
Vandenberghe et al.

(10) Patent No.: US 10,519,401 B2
(45) **Date of Patent: *Dec. 31, 2019**

(54) CLEANING COMPOSITION

(71) Applicant: The Procter & Gamble Company, Cincinnati, OH (US)

(72) Inventors: Frederik Clara P. Vandenberghe, Sint-Amands (BE); Robby Renilde Francois Keuleers, Lippelo (BE); Neil Joseph Lant, Newcastle Upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/678,684

(22) Filed: Aug. 16, 2017

(65) Prior Publication Data

US 2018/0087007 A1 Mar. 29, 2018

(30) Foreign Application Priority Data

Aug. 17, 2016 (EP) ..... 16184414.7
Mar. 21, 2017 (EP) ..... 17162052.9

(51) Int. Cl.

| | |
|---|---|
| ***C11D 1/83*** | (2006.01) |
| ***C11D 1/75*** | (2006.01) |
| ***C11D 3/386*** | (2006.01) |
| ***C11D 1/94*** | (2006.01) |
| *C11D 1/29* | (2006.01) |
| *C11D 1/90* | (2006.01) |

(52) U.S. Cl.

CPC ..... *C11D 1/83* (2013.01); *C11D 1/75* (2013.01); *C11D 1/94* (2013.01); *C11D 3/38618* (2013.01); *C11D 3/38663* (2013.01); *C11D 1/29* (2013.01); *C11D 1/90* (2013.01)

(58) Field of Classification Search

CPC ..... C11D 1/29

See application file for complete search history.

(56) References Cited

U.S. PATENT DOCUMENTS

| | | | | |
|---|---|---|---|---|
| 8,802,729 | B2 * | 8/2014 | Fenyvesi | A61Q 5/02 514/546 |
| 2002/0147123 | A1 * | 10/2002 | Becker | C11D 3/38 510/305 |
| 2011/0060126 | A1 * | 3/2011 | Viola | B01J 19/0046 530/350 |

FOREIGN PATENT DOCUMENTS

| | | | |
|---|---|---|---|
| WO | WO9412623 | A1 | 6/1994 |
| WO | WO9520025 | A1 | 7/1995 |
| WO | WO9712027 | A1 | 4/1997 |
| WO | WO9963034 | A1 | 12/1999 |
| WO | WO0046330 | A1 | 8/2000 |
| WO | WO0043476 | A3 | 11/2000 |

OTHER PUBLICATIONS

European Search Report for Application No./Patent No. 16184414.7-1375, dated Feb. 15, 2017, 10 pages.
European Search Report for Application No./Patent No. 17162052.9-1375, dated Aug. 31, 2017, 11 pages.

* cited by examiner

*Primary Examiner* — Bin Shen
(74) *Attorney, Agent, or Firm* — Melissa G. Krasovec

(57) ABSTRACT

A hand dishwashing cleaning composition comprising a surfactant system including an anionic surfactant and an amine oxide co-surfactant wherein the weight ratio of the surfactant system to the amine oxide is from about 1.5:1 to about 4.5:1 and wherein the composition further includes a protease and an enzyme stabilizer selected from the group consisting of: potassium salts of halides, sulfates, sulfites, carbonates, hydrogencarbonates, nitrates, nitrites, phosphates, formates, acetates, propionates, citrates, maleates, tartarates, succinates, oxalates and lactates; a peptide aldehyde, peptide ketone, a hydrosulfite adduct thereof; a phenyl boronic acid, a derivative thereof and mixtures thereof.

13 Claims, No Drawings

CLEANING COMPOSITION

FIELD OF THE INVENTION

The present invention is in the field of hand dishwashing. In particular, it relates to a hand dishwashing cleaning composition comprising a surfactant system comprising an anionic surfactant and an amine oxide co-surfactant, a protease and an enzyme stabilizer. The composition provides good cleaning and sudsing and it is stable in storage.

BACKGROUND OF THE INVENTION

Proteinaceous soils can be difficult to remove. Proteases are used in automatic dishwashing for the removal of proteinaceous soils. The incorporation of proteases in hand dishwashing cleaning compositions is challenging because hand dishwashing detergent compositions are usually based on anionic surfactants. Anionic surfactants seem to destabilize proteases on storage and in use.

The objective of the present invention is to provide a detergent composition that facilitates the hand dishwashing process and at the same time the composition is stable on storage.

SUMMARY OF THE INVENTION

According to the first aspect of the invention, there is provided a hand dishwashing cleaning composition, preferably in liquid form. The composition comprises a surfactant system, a protease and an enzyme stabilizer. The composition provides excellent cleaning and it is stable in storage.

The surfactant system of the composition of the invention comprises an anionic surfactant. Anionic surfactants contribute to destabilization of proteases, however, during the course of this work it has been surprisingly found that the destabilization effect is reduced by adding an amine oxide co-surfactant to the cleaning composition. Thus the composition of the invention comprises a surfactant system comprising an anionic surfactant, preferably an alkyl sulfate, alkyl alkoxy sulfate, or a mixture thereof, and an amine oxide co-surfactant. The surfactant system (i.e. all the surfactants present in the composition) and the amine oxide surfactant are in a weight ratio of from 1.5:1 to 4.5:1, preferably from 2:1 to 4:1, more preferably from 3:1 to 4:1. These ratios provide good cleaning and sudsing and stable compositions.

The composition can further comprise a zwitterionic surfactant, in particular a betaine surfactant and/or a non-ionic surfactant.

The anionic surfactant can be any anionic cleaning surfactant, preferred anionic surfactants are selected from the group consisting of alkyl sulfate, alkyl alkoxy sulfate, alkyl benzene sulfonate, paraffin sulfonate and mixtures thereof. Preferred anionic surfactants are selected from alkyl sulfate, alkyl alkoxy sulfate and mixtures thereof, a preferred alkyl alkoxy sulfate is alkyl ethoxy sulfate. The most preferred anionic surfactants for use herein are alkyl ethoxy sulfate surfactants.

The composition of the invention comprises a protease and an enzyme stabilizer selected from the group consisting of:

i) potassium salts of halides, sulfates, sulfites, carbonates, hydrogencarbonates, nitrates, nitrites, phosphates, formates, acetates, propionates, citrates, maleates, tartrates, succinates, oxalates and lactates;

ii) a peptide aldehyde or ketone and a hydrosulfite adduct thereof;

iii) a phenyl boronic acid or a derivative thereof; and iv) mixtures thereof.

The preferred enzyme stabilizer for use herein is potassium acetate.

A preferred composition according to the invention comprises:

i) from 10 to 30% by weight of the composition of anionic surfactant selected from the group comprising of alkyl sulfate, alkyl alkoxy sulfate and mixtures thereof, preferably the anionic surfactant comprises alkyl alkoxy sulfate;

ii) from 2.5 to 10% by weight of the composition of amine oxide;

iii) from 2.5 to 10% by weight of the composition of betaine;

iv) from 0.001 to 0.5% by weight of the composition of a protease;

v) from 0.05 to 1% by weight of the composition of potassium acetate; and vi) optionally an additional enzyme selected from the group consisting of amylase, lipase and mixtures thereof.

According to the second aspect of the invention there is provided the use of amine oxide to stabilise a protease in a detergent composition, preferably a hand dishwashing cleaning composition, comprising a surfactant system comprising an anionic surfactant.

The elements of the composition of the invention described in connection with the first aspect of the invention apply mutatis mutandis to the second aspect of the invention.

DETAILED DESCRIPTION OF THE INVENTION

The present invention envisages a hand dishwashing cleaning composition, comprising a surfactant system, a protease and an enzyme stabilizer. The composition of the invention provides very good cleaning and sudsing. The protease breaks down proteinaceous soils allowing the surfactant to access the soiled surfaces and preventing redeposition of the soils. The composition is more stable in storage than compositions free of amine oxide surfactant. The invention also envisages the use of amine oxide co-surfactants in a composition comprising anionic surfactant to improve the stability of proteases.

The Cleaning Composition

The cleaning composition is a hand dishwashing cleaning composition, preferably in liquid form. It typically contains from 30% to 95%, preferably from 40% to 90%, more preferably from 50% to 85% by weight of a liquid carrier in which the other essential and optional components are dissolved, dispersed or suspended. One preferred component of the liquid carrier is water.

Preferably the pH of the composition is from about 6 to about 12, more preferably from about 7 to about 11 and most preferably from about 7.5 to about 10, as measured at 25° C. and 10% aqueous concentration in distilled water. The pH of the composition can be adjusted using pH modifying ingredients known in the art.

Surfactant System

The cleaning composition comprises from about 1% to about 60%, preferably from about 5% to about 50% more preferably from about 8% to about 40% by weight thereof of a surfactant system. The surfactant system comprises an anionic surfactant, more preferably an anionic surfactant selected from the group consisting of alkyl sulfate, alkyl alkoxy surfate, and mixtures thereof. Preferably the anionic surfactant comprises an alkyl ethoxy sulfate surfactant. The system also comprises an amine oxide surfactant and optionally a zwitterionic surfactant and/or a non-ionic surfactant. The preferred zwitterionic surfactant for use herein is a betaine surfactant, in particular a cocoamidopropylbetaine. The preferred nonionic surfactant is an alcohol alkoxylate, in particular an alcohol ethoxylate nonionic surfactant.

Preferably, the cleaning composition of the present invention comprise from 10% to 30%, more preferably 15% to 25% by weight of the total composition of an anionic surfactant, preferably the anionic surfactant is selected from the group consisting of alkyl sulfate surfactant, alkyl alkoxy sulfate surfactant and mixtures thereof, more preferably the anionic surfactant comprises an alkyl ethoxy sulfate.

Preferably, the cleaning composition of the present invention comprise from 2.5% to 10%, more preferably 4% to 8% by weight of the total composition of an amine oxide surfactant, preferably an alkyl dimethyl amine oxide. Preferably the weight ratio of the anionic surfactant to the amine oxide is from 1:1 to 5:1, preferably from 2:1 to 4:1, more preferably from 2.5:1 to 3.5:1. Surfactants systems having these ratios are very good in terms of suds and provide good cleaning, in combination with the protease. If the composition comprises a betaine surfactant the weight ratio of amine oxide to betaine is preferably from 2:1 to 1:2, more preferably 1.5:1 to 1:1.5. If the cleaning composition of the present invention comprises a betaine surfactant it preferably comprises from 2.5% to 10%, more preferably 4% to 8% by weight of the total composition of the betaine surfactant, preferably cocoamidopropylbetaine surfactant.

Anionic Surfactant

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C 8-C 22 alkyl, or acyl group. Such surfactants are employed in the form of water-soluble salts and the salt-forming cation usually is selected from sodium, potassium, ammonium, magnesium and mono-, di- or tri-C alkanolammonium, with the sodium, cation being the usual one chosen.

The anionic surfactant can be a single surfactant but usually it is a mixture of anionic surfactants. Preferably the anionic surfactant comprises a sulfate surfactant, more preferably a sulfate surfactant selected from the group consisting of alkyl sulfate, alkyl alkoxy sulfate and mixtures thereof. Preferred alkyl alkoxy sulfates for use herein are alkyl ethoxy sulfates.

Sulfated Anionic Surfactant

Preferably the sulfated anionic surfactant is alkoxylated, more preferably, an alkoxylated branched sulfated anionic surfactant having an alkoxylation degree of from about 0.2 to about 4, even more preferably from about 0.3 to about 3, even more preferably from about 0.4 to about 1.5 and especially from about 0.4 to about 1. Preferably, the alkoxy group is ethoxy. When the sulfated anionic surfactant is a mixture of sulfated anionic surfactants, the alkoxylation degree is the weight average alkoxylation degree of all the components of the mixture (weight average alkoxylation degree). In the weight average alkoxylation degree calculation the weight of sulfated anionic surfactant components not having alkoxylated groups should also be included.

Weight average alkoxylation degree=
($x1$*alkoxylation degree of surfactant 1+$x2$*alkoxylation degree of surfactant 2+ . . . )/ ($x1$+$x2$+ . . . )

wherein x1, x2, . . . are the weights in grams of each sulfated anionic surfactant of the mixture and alkoxylation degree is the number of alkoxy groups in each sulfated anionic surfactant.

Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfated anionic surfactant used in the detergent of the invention. Most preferably the branched sulfated anionic surfactant is selected from alkyl sulfates, alkyl ethoxy sulfates, and mixtures thereof.

The branched sulfated anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

Weight average of branching (%)=[($x1$*wt % branched alcohol 1 in alcohol 1+$x2$*wt % branched alcohol 2 in alcohol 2+ . . . )/ ($x$+$x2$+ . . . )]*100 wherein x1, x2, . . . are the weight in grams of each alcohol in the total alcohol mixture of the alcohols which were used as starting material for the anionic surfactant for the detergent of the invention. In the weight average branching degree calculation the weight of anionic surfactant components not having branched groups should also be included.

Suitable sulfate surfactants for use herein include water-soluble salts of C8-C18 alkyl or hydroxyalkyl, sulfate and/or ether sulfate. Suitable counterions include alkali metal cation or ammonium or substituted ammonium, but preferably sodium.

The sulfate surfactants may be selected from C8-C18 primary, branched chain and random alkyl sulfates (AS); C8-C18 secondary (2,3) alkyl sulfates; C8-C18 alkyl alkoxy sulfates (AExS) wherein preferably x is from 1-30 in which the alkoxy group could be selected from ethoxy, propoxy, butoxy or even higher alkoxy groups and mixtures thereof.

Alkyl sulfates and alkyl alkoxy sulfates are commercially available with a variety of chain lengths, ethoxylation and branching degrees. Commercially available sulfates include, those based on Neodol alcohols ex the Shell company, Lial-Isalchem and Safol ex the Sasol company, natural alcohols ex The Procter & Gamble Chemicals company.

Preferably, the anionic surfactant comprises at least 50%, more preferably at least 60% and especially at least 70% of a sulfate surfactant by weight of the anionic surfactant. Especially preferred detergents from a cleaning view point are those in which the anionic surfactant comprises more than 50%, more preferably at least 60% and especially at least 70% by weight thereof of sulfate surfactant and the sulfate surfactant is selected from the group consisting of alkyl sulfates, alkyl ethoxy sulfates and mixtures thereof. Even more preferred are those in which the anionic surfactant is an alkyl ethoxy sulfate with a degree of ethoxylation of from about 0.2 to about 3, more preferably from about 0.3 to about 2, even more preferably from about 0.4 to about 1.5, and especially from about 0.4 to about 1. They are also preferred anionic surfactant having a level of branching of from about 5% to about 40%, even more preferably from about 10% to 35% and especially from about 20% to 30%.

Sulfonate Surfactant

Suitable sulfonate surfactants for use herein include water-soluble salts of C8-C18 alkyl or hydroxyalkyl sulfonates; C11-C18 alkyl benzene sulfonates (LAS), modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulfonate (MES); and alpha-olefin sulfonate (AOS). Those also include the paraffin sulfonates may be monosulfonates and/or disulfonates, obtained by sulphonating paraffins of 10 to 20 carbon atoms. The sulfonate surfactant also includes the alkyl glyceryl sulfonate surfactants.

Amine Oxide Co-Surfactant

Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Zwitterionic Surfactant

Other suitable surfactants include betaines, such as alkyl betaines, alkylamidobetaine, amidazoliniumbetaine, sulfobetaine (INCI Sultaines) as well as the Phosphobetaine and preferably meets formula (I):

R1-[CO—X(CH2)*n*]*x*-N+(R2XR3)-(CH2)*m*-[CH(OH)—CH2]*y*-Y— (I)

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S, n a number from 1 to 10, preferably 2 to 5, in particular 3, x 0 or 1, preferably 1, R2, R3 are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, OPO(OR5)O or P(OXOR5)O, whereby R5 is a hydrogen atom H or a C1-4 alkyl residue.

Preferred betaines are the alkyl betaines of the formula (Ia), the alkyl amido propyl betaine of the formula (Ib), the Sulfo betaines of the formula (Ic) and the Amido sulfobetaine of the formula (Id);

R1-N+(CH3)2-CH2COO— (Ia)

R1-CO—NH(CH2)3-N+(CH3)2-CH2COO— (Ib)

R1-N+(CH3)2-CH2CH(OH)CH2SO3- (Ic)

R1-CO—NH—(CH2)3-N+(CH3)2-CH2CH(OH)CH2SO3- (Id) in which R11 as the same meaning as in formula I. Particularly preferred betaines are the Carbobetaine [wherein Y—=COO—], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropylbetaine.

Non Ionic Surfactant

Nonionic surfactant, when present, is comprised in a typical amount of from 0.1% to 40%, preferably 0.2% to 20%, most preferably 0.5% to 10% by weight of the composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol. Highly preferred nonionic surfactants are the condensation products of guerbet alcohols with from 2 to 18 moles, preferably 2 to 15, more preferably 5-12 of ethylene oxide per mole of alcohol.

Other suitable non-ionic surfactants for use herein include fatty alcohol polyglycol ethers, alkylpolyglucosides and fatty acid glucamides.

Protease

The composition of the invention comprises a protease. The protease is present in the composition of the invention in a preferred level of from about 0.0001 to about 1%, more preferably from about 0.001 to about 0.5% and especially from about 0.005 to about 0.3% of active protease by weight of the composition.

Suitable proteases include those of bacterial, fungal, plant, viral or animal origin e.g. vegetable or microbial origin. Microbial origin is preferred. Chemically modified or protein engineered mutants are included. It may be an alkaline protease, such as a serine protease or a metalloprotease. A serine protease may for example be of the S1 family, such as trypsin, or the S8 family such as subtilisin. A metalloproteases protease may for example be a thermolysin from e.g. family M4 or other metalloprotease such as those from M5, M7 or M8 families.

The term "subtilases" refers to a sub-group of serine protease according to Siezen et al., 1991, Protein Engng. 4: 719-737 and Siezen et al., 1997, Protein Science 6: 501-523. Serine proteases are a subgroup of proteases characterized by having a serine in the active site, which forms a covalent adduct with the substrate. The subtilases may be divided into 6 sub-divisions, i.e. the Subtilisin family, the Thermitase family, the Proteinase K family, the Lantibiotic peptidase family, the Kexin family and the Pyrolysin family.

Examples of subtilases are those derived from *Bacillus* such as *Bacillus lentus, B. alkalophilus, B. subtilis, B. amyloliquefaciens, Bacillus pumilus* and *Bacillus gibsonii* described in; U.S. Pat. No. 7,262,042 and WO 2009/021867, and subtilisin *lentus*, subtilisin Novo, subtilisin Carlsberg, *Bacillus licheniformis*, subtilisin BPN', subtilisin 309, subtilisin 147 and subtilisin 168 described in WO 89/06279 and protease PD138 described in (WO 93/18140). Other useful proteases may be those described in WO 92/175177, WO 01/16285, WO 02/026024 and WO 02/016547. Examples of trypsin-like proteases are trypsin (e.g. of porcine or bovine origin) and the *Fusarium* protease described in WO 89/06270, WO 94/25583 and WO 2005/040372, and the chymotrypsin proteases derived from Cellumonas described in WO 2005/052161 and WO 2005/052146.

A further preferred protease is the alkaline protease from *Bacillus lentus* DSM 5483, as described for example in WO 95/23221, and variants thereof which are described in WO 92/21760, WO 95/23221, EP 1921 147 and EP 1921 148.

Examples of metalloproteases are the neutral metalloprotease as described in WO 2007/044993 (Genencor Int.) such as those derived from *Bacillus amyloliquefaciens.*

Examples of useful proteases are the variants described in: WO92/19729, WO96/034946, WO98/201 15, WO98/201 16, WO99/01 1768, WO01/44452, WO03/006602, WO2004/03186, WO2004/041979, WO2007/006305, WO201 1/036263, WO201 1/036264, especially the variants with substitutions in one or more of the following positions: 3, 4, 9, 15, 27, 36, 57, 68, 76, 87, 95, 96, 97, 98, 99, 100, 101, 102, 103, 104, 106, 1 18, 120, 123, 128, 129, 130, 160, 167, 170, 194, 195, 199, 205, 206, 217, 218, 222, 224, 232, 235, 236, 245, 248, 252 and 274 using the BPN' numbering. More preferred the subtilase variants may comprise the mutations: S3T, V4I, S9R, A15T, K27R, *36D, V68A, N76D, N87S, R, *97E, A98S, S99G, D, A, S99AD, S101 G, M, R S103A, V104I, Y, N, S106A, G1 18V, R, H120D, N, N123S, S128L, P129Q, S130A, G160D, Y167A, R170S, A194P, G195E, V199M, V205I, L217D, N218D, M222S, A232V, K235L, Q236H, Q245R, N252K, T274A (using BPN' numbering).

Suitable commercially available protease enzymes include those sold under the trade names Alcalase™, Duralase™, Durazym™, Relase™, Relase™ Ultra, Savinase™, Savinase™ Ultra, Primase™, Polarzyme™, Kannase™, Liquanase™, Liquanase™ Ultra, Ovozyme™, Coronase™, Coronase™ Ultra, Neutrase™, Everlase™ and Esperase™ (Novozymes A/S), those sold under the tradename Maxatase™, Maxacal™, Maxapem™, Purafect™, Purafect Prime™, Preferenz™, Purafect MA™, Purafect Ox™, Purafect OxP™, Puramax™, Properase™, Effectenz™, FN2™, FN3™, FN4™, Excellase™, , Opticlean™ and Optimase™ (Danisco/DuPont), Axapem™ (Gist-Brocases N.V.), BLAP (sequence shown in FIG. 29 of U.S. Pat. No. 5,352,604) and variants hereof (Henkel AG) and KAP (*Bacillus alkalophilus* subtilisin) from Kao.

Enzyme Stabilizer

The protease of the composition of the invention is stabilized by the amine oxide co-surfactant and further stabilized by the enzyme stabilizer. The composition of the invention comprises at least 0.05%, preferably at least 0.15%, more preferably at least 0.25% and most preferably at least 0.35% by weight of the composition of the enzyme stabilizer. The composition preferably comprises from 0.05 to 4%, more preferably from 0.1 to 3%, more preferably from 0.15 to 2% and especially from 0.20 to 1% or from 0.25 to 0.5% by weight of the composition of the enzyme stabilizer.

The enzyme stabilizer is preferably selected from the group consisting of potassium salts of halides, sulfates, sulfites, carbonates, hydrogencarbonates, nitrates, nitrites, phosphates, formates, acetates, propionates, citrates, maleates, tartarates, succinates, oxalates, lactates, and mixtures thereof, preferably selected from the group consisting of potassium chloride, potassium sulfate, potassium acetate, potassium formate, potassium propionate, potassium lactate and mixtures thereof, more preferably potassium acetate, potassium chloride and mixtures thereof, most preferably potassium acetate.

Other enzyme stabilizers suitable for use in the composition of the invention include proteases inhibitors, such as a peptide aldehyde or ketone, or a hydrosulfite adduct thereof; or a phenyl boronic acid, or a derivative thereof.

Suitable subtilisin inhibitors are aldehydes or ketone having the formula $P\text{-}(A)_y\text{-}L\text{-}(B)_x\text{—}B^o\text{—}R^*$ or a hydrosulfite adduct of such aldehyde, wherein:

a) R* is H (hydrogen), $CH_3$, $CX_3$, $CHX_2$, or $CH_2X$;

b) X is a halogen atom;

c) $B^o$ is a single amino acid residue with L- or D-configuration of the formula —NH—CH(R)—C(=0)-;

d) x is 1, 2 or 3;

e) $B_x$ is independently a single amino acid residue, each connected to the next B or to $B^o$ via its C-terminal;

f) L is absent or independently a linker group of the formula —C(=O)—, —C(=O)—C(=O)—, —C(=S)—, —C(=—S)—C(=—S)— or —C(=—S)—C(=—O)—;

g) A is absent if L is absent or is independently a single amino acid residue connected to L via the N-terminal of the amino acid;

h) P is selected from the group consisting of hydrogen or if L is absent an N-terminal protection group;

i) y is 0, 1, or 2, j) R is independently selected from the group consisting of $C_{1-6}$ alkyl, $C_{6-10}$ aryl or $C_{7-10}$ arylalkyl optionally substituted with one or more, identical or different, substituent's R';

k) R' is independently selected from the group consisting of halogen, —OH, —OR", —SH, —SR", —$NH_2$, —NHR", —$NR"_2$, —$CO_2H$, —$CONH_2$, —CONHR", —$CONR"_2$, —NHC(=N)$NH_2$; and l) R" is a $C_{1-6}$ alkyl group, m) x may be 1, 2 or 3.

Preferably, the inhibitor is an aldehyde having the formula P—$B^2$—$B^1$—$B^o$—H or an adduct having the formula P—$B^2$—$B^1$—N(H)—CHR—CHOH—$SO_3M$, wherein a) H is hydrogen;

b) $B^o$ is a single amino acid residue with L- or D-configuration of the formula —NH—CH(R)—C(=O)—;

c) $B^1$ and $B^2$ are independently single amino acid residues;

d) R is independently selected from the group consisting of $C_{1-6}$ alkyl, $C_{6-10}$ aryl or $C_{7-10}$ arylalkyl optionally substituted with one or more, identical or different, substituent's R';

e) R' is independently selected from the group consisting of halogen, —OH, —OR", —SH, —SR", —$NH_2$, —NHR", —$NR"_2$, —$CO_2H$, —$CONH_2$, —CONHR", —$CONR"_2$, —NHC(=N)$NH_2$;

f) R" is a $C_{1-6}$ alkyl group; and g) P is an N-terminal protection group.

In an embodiment, R is such that $B^o$=—NH—CH(R)—C(=0)- is Phe, Tyr or Leu.

In an embodiment, $B^1$ is Ala, Gly or Val.

In an embodiment, $B^2$ is Arg, Phe, Tyr or Trp.

In an embodiment, x=2, L is absent, A is absent, and P is p-methoxycarbonyl (Moc) or benzyloxycarbonyl (Cbz).

In an embodiment, the inhibitor of the composition is Cbz-Arg-Ala-Tyr-H, Ac-Gly-Ala-Tyr-H, Cbz-Gly-Ala-Tyr-H, Cbz-Gly-Ala-Tyr-$CF_3$, Cbz-Gly-Ala-Leu-H, Cbz-Val-Ala-Leu-H, Cbz-Val-Ala-Leu-$CF_3$, Moc-Val-Ala-Leu-$CF_3$, Cbz-Gly-Ala-Phe-H, Cbz-Gly-Ala-Phe-$CF_3$, Cbz-Gly-Ala-Val-H, Cbz-Gly-Gly-Tyr-H, Cbz-Gly-Gly-Phe-H, Cbz-Arg-Val-Tyr-H, Cbz-Leu-Val-Tyr-H, Ac-Leu-Gly-Ala-Tyr-H, Ac-Phe-Gly-Ala-Tyr-H, Ac-Tyr-Gly-Ala-Tyr-H, Ac-Phe-Gly-Ala-Leu-H, Ac-Phe-Gly-Ala-Phe-H, Ac-Phe-Gly-Val-Tyr-H, Ac-Phe-Gly-Ala-Met-H, Ac-Trp-Leu-Val-Tyr-H, MeO—CO-Val-Ala-Leu-H, MeNCO-Val-Ala-Leu-H, MeO—CO-Phe-Gly-Ala-Leu-H, MeO—CO-Phe-Gly-Ala-Phe-H, $MeSO_2$-Phe-Gly-Ala-Leu-H, $MeSO_2$-Val-Ala-Leu-H, $PhCH_2O$—P(OH)(O)-Val-Ala-Leu-H, $EtSO_2$-Phe-Gly-Ala-Leu-H, $PhCH_2SO_2$-Val-Ala-Leu-H, $PhCH_2O$—P(OHXO)-Leu-Ala-Leu-H, $PhCH_2O$—P(OH)(O)-Phe-Ala-Leu-H, or MeO—P(OH)(O)-Leu-Gly-Ala-Leu-H or a hydrosulfite adduct of any of these, wherein Cbz is benzyloxycarbonyl and Moc is methoxycarbonyl.

Preferably, the inhibitor is Cbz-Gly-Ala-Tyr-H or Moc-Val-Ala-Leu-H, or a hydrosulfite adduct thereof, wherein Cbz is benzyloxycarbonyl and Moc is methoxycarbonyl. Most preferably, the inhibitor is Cbz-Gly-Ala-Tyr-H, or a hydrosulfite adduct thereof, wherein Cbz is benzyloxycarbonyl.

Suitable phenylboronic acids include those of the following formula

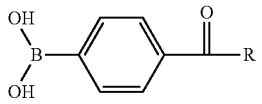

where R is selected from the group consisting of hydrogen, hydroxy, $C_{1-6}$ alkyl, substituted $C_{1-6}$ alkyl, $C_{1-6}$ alkenyl and substituted $C_{1-6}$ alkenyl. Preferably the phenylboronic acid is 4-formyl-phenylboronic acid.

Additional Enzymes

Additional enzyme(s) which may be comprised in the composition of the invention include one or more enzymes such as cutinase, lipase, catalase, amylase, carbohydrase, cellulase, pectinase, mannanase, arabinase, galactanase, xylanase, perhydrolase, oxidase, e.g., laccase, and/or peroxidase.

A preferred combination of enzymes comprises, a protease and an amylase or a protease and a lipase and amylase. Optionally the composition comprises a catalase. When present the additional enzymes may be present at levels from 0.00001 to 2 wt %, from 0.0001 to 1 wt % or from 0.001 to 0.5 wt % enzyme protein by weight of the composition.

Amylases: Suitable amylases include alpha-amylases and/or glucoamylases and may be of bacterial or fungal origin. Chemically modified or protein engineered mutants are included. Amylases include, for example, alpha-amylases obtained from *Bacillus*, e.g., a special strain of *Bacillus licheniformis*, described in more detail in GB 1,296,839.

Suitable amylases include amylases disclosed in WO 95/10603 or variants having 90% sequence identity to the amylases disclosed thereof. Preferred variants are described in WO 94/02597, WO 94/18314, WO 97/43424 WO 99/019467, such as variants with substitutions in one or more of the following positions: 15, 23, 105, 106, 124, 128, 133, 154, 156, 178, 179, 181, 188, 190, 197, 201, 202, 207, 208, 209, 21 1, 243, 264, 304, 305, 391, 408, and 444.

Different suitable amylases include amylases disclosed in WO 02/010355 or variants thereof having 90% sequence identity to the amylases disclosed therein. Preferred variants of the amylases disclosed are those having a deletion in positions 181 and 182 and a substitution in position 193. Other amylases which are suitable are hybrid alpha-amylase comprising residues 1-33 of the alpha-amylase derived from *B. amyloliquefaciens* shown in the amylases disclosed in WO 2006/066594 and residues 36-483 of the *B. licheniformis* alpha-amylase shown in the amylases disclosed in WO 2006/066594 or variants having 90% sequence identity thereof. Preferred variants of this hybrid alpha-amylase are those having a substitution, a deletion or an insertion in one of more of the following positions: G48, T49, G107, H156, A181, N190, M197, 1201, A209 and Q264. Most preferred variants of the hybrid alpha-amylase comprising residues 1-33 of the alpha-amylase derived from *B. amyloliquefaciens* shown in the amylases disclosed in WO 2006/066594 and residues 36-483 of the amylases disclosed are those having the substitutions:

M197T;

H156Y+A181T+N190F+A209V+Q264S; or

G48A+T49I+G107A+H156Y+A181T+N190F+I201F+A209V+Q264S.

Further amylases which are suitable are amylases disclosed in WO99/019467 or variants thereof having 90% sequence identity to amlyases disclosed. Preferred variants of the amylases disclosed are those having a substitution, a deletion or an insertion in one or more of the following positions: R181, G182, H183, G184, N195, 1206, E212, E216 and K269. Particularly preferred amylases are those having deletion in positions R181 and G182, or positions H183 and G184.

Additional amylases which can be used are those amylases disclosed in WO 96/023873 or variants thereof having 90% sequence identity to the amylases disclosed. Preferred variants of the amylases disclosed are those having a substitution, a deletion or an insertion in one or more of the following positions: 140, 181, 182, 183, 184, 195, 206, 212, 243, 260, 269, 304 and 476, using the amylases disclosed in WO 96/023873 for numbering. More preferred variants are those having a deletion in two positions selected from 181, 182, 183 and 184, such as 181 and 182, 182 and 183, or positions 183 and 184. Most preferred amylase variants of the amylases having a deletion in positions 183 and 184 and a substitution in one or more of positions 140, 195, 206, 243, 260, 304 and 476.

Other amylases which can be used are amylases disclosed in WO08/153815, amylases disclosed in WO 01/66712 or variants thereof having 90% sequence identity to amylases disclosed in WO 08/153815 or 90% sequence identity to amylases disclosed in WO 01/66712. Preferred variants of amylases disclosed in WO 01/66712 are those having a substitution, a deletion or an insertion in one of more of the following positions: 176, 177, 178, 179, 190, 201, 207, 21 1 and 264.

Further suitable amylases are amylases disclosed in WO 09/061380 or variants having 90% sequence identity to amylases disclosed thereof. Preferred variants of the amylases disclosed are those having a truncation of the C-terminus and/or a substitution, a deletion or an insertion in one of more of the following positions: Q87, Q98, 5125, N128, T131, T165, K178, R180, 5181. T182, G183, M201, F202, N225, 5243, N272, N282, Y305, R309, D319, Q320, Q359, K444 and G475. More preferred variants of the amylases disclosed are those having the substitution in one of more of the following positions: Q87E,R, Q98R, S125A, N128C, T131 I, T165I, K178L, T182G, M201 L, F202Y, N225E,R, N272E,R, S243Q,A,E,D, Y305R, R309A, Q320R, Q359E, K444E and G475K and/or deletion in position R180 and/or 5181 or of T182 and/or G183. Most preferred amylase variants of the amylases disclosed are those having the substitutions:

N128C+K178L+T182G+Y305R+G475K;

N128C+K178L+T182G+F202Y+Y305R+D319T+G475K;

S125A+N128C+K178L+T182G+Y305R+G475K; or

S125A+N128C+T131 I+T165I+K178L+T182G+Y305R+G475K wherein the variants are C-terminally truncated and optionally further comprises a substitution at position 243 and/or a deletion at position 180 and/or position 181.

Further suitable amylases are amylases disclosed in W013184577 or variants having 90% sequence identity to amylases disclosed thereof. Preferred variants of amylases disclosed are those having a substitution, a deletion or an insertion in one of more of the following positions: K176, R178, G179, T180, G181, E187, N192, M199, 1203, 5241, R458, T459, D460, G476 and G477. More preferred variants of amylases disclosed are those having the substitution in one of more of the following positions: K176L, E187P, N192FYH, M199L, I203YF, 5241 QADN, R458N, T459S, D460T, G476K and G477K and/or deletion in position R178 and/or 5179 or of T180 and/or G181. Most preferred amylase variants of amylases disclosed are those having the substitutions:

E187P+I203Y+G476K

E187P+I203Y+R458N+T459S+D460T+G476K wherein the variants optionally further comprises a substitution at position 241 and/or a deletion at position 178 and/or position 179.

Further suitable amylases are amylases disclosed in W010104675 or variants having 90% sequence identity to amylases disclosed thereof. Preferred variants of amylases disclosed are those having a substitution, a deletion or an insertion in one of more of the following positions: N21, D97, V128 K177, R179, S180, 1181, G182, M200, L204, E242, G477 and G478. More preferred variants of amylases disclosed are those having the substitution in one of more of the following positions: N21 D, D97N, V128I K177L, M200L, L204YF, E242QA, G477K and G478K and/or deletion in position R179 and/or 5180 or of 1181 and/or G182. Most preferred amylase variants of amylases disclosed are those having the substitutions:

N21D+D97N+V128I wherein the variants optionally further comprises a substitution at position 200 and/or a deletion at position 180 and/or position 181.

Other suitable amylases are the alpha-amylase disclosed in WO01/66712 or a variant having at least 90% sequence identity to amylases disclosed therein. Preferred amylase variants are those having a substitution, a deletion or an insertion in one of more of the following positions of the amylases disclosed in WO01/66712: R28, R1 18, N174; R181, G182, D183, G184, G186, W189, N195, M202, Y298, N299, K302, 5303, N306, R310, N314; R320, H324, E345, Y396, R400, W439, R444, N445, K446, Q449, R458, N471, N484. Particular preferred amylases include variants having a deletion of D183 and G184 and having the substitutions R1 18K, N195F, R320K and R458K, and a variant additionally having substitutions in one or more position selected from the group: M9, G149, G182, G186, M202, T257, Y295, N299, M323, E345 and A339, most preferred a variant that additionally has substitutions in all these positions.

Other examples are amylase variants such as those described in WO2011/098531, WO2013/001078 and WO2013/001087.

Commercially available amylases are Duramyl™, Termamyl™, Fungamyl™, Stainzyme™, Stainzyme Plus™, Natalase™, Liquozyme X™ and BAN™ (from Novozymes A S), and Rapidase™, Purastar™/Effectenz™, Powerase™, Preferenz S1000™, Preferenz S100™ and Preferenz S1 10™ (from Genencor International Inc./DuPont).

Lipases and Cutinases: Suitable lipases and cutinases include those of bacterial or fungal origin. Chemically modified or protein engineered mutant enzymes are included. Examples include lipase from *Thermomyces*, e.g. from *T. lanuginosus* (previously named *Humicola lanuginosa*) as described in EP258068 and EP305216, cutinase from *Humicola*, e.g. *H. insolens* (WO96/13580), lipase from strains of *Pseudomonas* (some of these now renamed to *Burkholderia*), e.g. *P. alcaligenes* or *P. pseudoalcaligenes* (EP218272), *P. cepacia* (EP331376), *P.* sp. strain SD705 (WO95/06720 & WO96/27002), *P. wisconsinensis* (WO96/12012), GDSL-type *Streptomyces* lipases (WO10/065455), cutinase from *Magnaporthe grisea* (WO10/107560), cutinase from *Pseudomonas mendocina* (U.S. Pat. No. 5,389,536), lipase from *Thermobifida fusca*(WO11/084412), *Geobacillus stearothermophilus* lipase (WO 11/084417), lipase from *Bacillus subtilis* (WO 11/084599), and lipase from *Streptomyces griseus* (WO11/150157) and *S. pristinaespiralis* (WO12/137147).

Other examples are lipase variants such as those described in EP407225, WO92/05249, WO94/01541, WO94/25578, WO95/14783, WO95/30744, WO95/35381, WO95/22615, WO96/00292, WO97/04079, WO97/07202, WO00/34450, WO00/60063, WO01/92502, WO07/87508 and WO09/109500.

Preferred commercial lipase products include Lipolase™, Lipex™; Lipolex™ and Lipoclean™ (Novozymes A/S), Lumafast™ (originally from Genencor) and Lipomax™ (originally from Gist-Brocades).

Lyases: The lyase may be a pectate lyase derived from *Bacillus*, particularly *B. licheniformis* or *B. agaradhaerens*, or a variant derived of any of these, e.g. as described in U.S. Pat. No. 6,124,127, WO 99/27083, WO 99/27084, WO 02/006442, WO 02/092741, WO 03/095638, Commercially available pectate lyases are XPect™; Pectawash™ and Pectaway™ (Novozymes A/S).

Mannanases: Suitable mannanases include those of bacterial or fungal origin. Chemically or genetically modified mutants are included. The mannanase may be an alkaline mannanase of Family 5 or 26. It may be a wild-type from *Bacillus* or *Humicola*, particularly *B. agaradhaerens, B. licheniformis, B. halodurans, B. clausii*, or *H. insolens*. Suitable mannanases are described in WO 1999/064619. A commercially available mannanase is Mannaway™ (Novozymes A/S).

Hydrogen Peroxide

The composition of the invention can comprise from 1 ppm to 100 ppm, preferably from 5 ppm to 75 ppm and more preferably from 50 ppm to 300 ppm of hydrogen peroxide. The hydrogen peroxide can be a by-product in the synthesis of amine oxide surfactants and acts a preservative for the amine oxide surfactant. Compositions comprising hydrogen peroxide preferably comprise a catalase. Catalases catalyse the decomposition of hydrogen peroxide to hydrogen and oxygen.

The detergent composition herein may comprise a number of optional ingredients such as builders, chelants, conditioning polymers, cleaning polymers, surface modifying polymers, soil flocculating polymers, structurants, emollients, humectants, skin rejuvenating actives, magnesium cations, carboxylic acids, scrubbing particles, bleach and bleach activators, perfumes, malodor control agents, pigments, dyes, opacifiers, beads, pearlescent particles, microcapsules, antibacterial agents, pH adjusters, preservatives, buffering means or water or any other dilutents or solvents compatible with the formulation.

Method of Washing

Washing the dishware with the composition of the present invention can be done by applying the composition directly onto the dishware surface, either directly or by means of a cleaning implement, i.e., in neat form or by diluting the cleaning composition in a sink full of water.

By "in its neat form", it is meant herein that said composition is not diluted in a full sink of water. The composition is applied directly onto the surface to be treated and/or onto a cleaning device or implement such as a dish cloth, a sponge or a dish brush without undergoing major dilution (immediately) prior to the application. The cleaning device or implement is preferably wet before or after the composition is delivered to it. The cleaning mechanism that takes place when compositions are used in neat form seems to be quite different to that taken place when compositions are used in diluted form.

There is also provided a method of washing dishware in full sink wherein a volume of water is provided, the cleaning composition is delivered to the volume of water and the dishware is immersed therein.

Examples

The below examples illustrate the improved stability of proteases when amine oxide is added to a composition comprising an alkyl ethoxy sulfate surfactant. The stability of the enzymes further improves by the addition of potassium acetate. The retention of enzymes in compositions freshly made and after the compositions were stored in 30 ml glass vials for 8 days at 32° C. were measured.

Test Products

The following hand dishwashing liquid detergent formulations were prepared.

| % active by weight of the composition | Comparative Example A1/A2 | Comparative Example B1/B2 | Comparative Example C1/C2 | Example A1/A2 | Example B1/B2 | Example C1/C2 |
|---|---|---|---|---|---|---|
| C12-13-14 alkyl ethoxy (0.6) sulfate (AES) | 28.1% | 28.1% | 28.1% | 21.1% | 21.1% | 21.1% |
| C12-14 dimethyl amine oxide (32% active - with 200 ppm residual H2O2) | — | — | — | 7.0% | 7.0% | 7.0% |
| Sodium citrate | 1.0% | 1.0% | 1.0% | 1.0% | 1.0% | 1.0% |
| Greenbentin DE/080 | 1.0% | 1.0% | 1.0% | 1.0% | 1.0% | 1.0% |
| NaCl | 0.7% | 0.7% | 0.7% | 0.7% | 0.7% | 0.7% |
| Polypropyleneglycol (MW 2000) | 0.75% | 0.75% | 0.75% | 0.75% | 0.75% | 0.75% |
| Ethanol | 1.7% | 1.7% | 1.7% | 1.7% | 1.7% | 1.7% |
| Protease Dupont V42 | 100 ppm | — | 100 ppm | 100 ppm | — | 100 ppm |
| Amylase Everest 200L | — | 100 ppm | 100 ppm | — | 100 ppm | 100 ppm |
| K-acetate | —/ 0.2% | —/ 0.2% | —/ 0.2% | —/ 0.2% | —/ 0.2% | —/ 0.2% |
| pH (10% dilution in demi water at 20° C.) - with NaOH | 9 | 9 | 9 | 9 | 9 | 9 |
| Water and minors (dye, perfume, preservative) | Balance to 100% | Balance to 100% | Balance to 100% | Balance to 100% | Balance to 100% | Balance to 100% |

Test Results

The enzyme stability data tabulated below show that compositions according to the invention (Example A-B-C) show good amylase stability and an improved protease stability compared to 5 compositions outside the scope of the invention not comprising amine oxide co-surfactant (comparative examples A-B-C). Formulations comprising K-acetate (Examples A2-B2-C2) show a further improved protease and amylase stability compared to formulations not comprising K-acetate (Examples A1-B-C1).

| % remaining of fresh | | Comparative Example A | Comparative Example B | Comparative Example C | Example A | Example B | Example C |
|---|---|---|---|---|---|---|---|
| Without K-acetate (A1-B1-C1) | Protease | 62.3 | — | 69.2 | 92.1 | — | 93.3 |
| | Amylase | — | 97.8 | 97.6 | — | 94.1 | 96.9 |
| With K-acetate (A2-B2-C2 | Protease | 69.2 | — | 71.2 | 99.7 | — | 100 |
| | Amylase | — | 98.7 | 97.6 | — | 93.6 | 100 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hand dishwashing cleaning composition comprising a surfactant system comprising an alkyl ethoxy sulfate surfactant and an amine oxide co-surfactant wherein the weight ratio of the alkyl ethoxy sulfate surfactant to the amine oxide is from about 1:1 to about 5:1 and wherein the composition further comprises a protease and an enzyme stabilizer, wherein the enzyme stabilizer comprises potassium acetate.

2. The composition according to claim 1 wherein the weight ratio of the surfactant system to the amine oxide is from about 1.5:1 to about 4.5:1.

3. The composition according to claim 1 comprising from about 10 to about 30% by weight of the composition of alkyl ethoxy sulfate surfactant and from about 2.5 to about 10% by weight of the composition of amine oxide.

4. The composition according to claim 1 further comprising a zwitterionic surfactant.

5. The composition according to claim 4 wherein the zwitterionic surfactant is a betaine surfactant.

6. The composition according to claim 5 wherein the betaine surfactant is a cocoamidopropylbetaine surfactant.

7. The composition according to claim 5 wherein the weight ratio of amine oxide to betaine is from about 2:1 to about 1:2.

8. The composition according to claim 1 comprising at least about 0.05% by weight of the composition of the enzyme stabilizer.

9. The composition according to claim 1 wherein the level of protease is from about 0.0001 to about 1% by weight of the composition.

10. The composition according to claim 1 comprising an additional enzyme selected from amylase, lipase and mixtures thereof.

11. The composition according to claim 1 comprising from about 1 ppm to about 100 ppm of hydrogen peroxide.

12. The composition according to claim 11 comprising a catalase.

13. The composition according to claim 1 comprising:

i) from about 10 to about 30% by weight of the composition of alkyl ethoxy sulfate surfactant;

ii) from about 2.5 to about 10% by weight of the composition of amine oxide;

iii) from about 2.5 to about 10% by weight of the composition of betaine;

iv) from about 0.001 to about 0.5% by weight of the composition of a protease;

v) from about 0.05 to about 1% by weight of the composition of potassium acetate; and vi) an additional enzyme selected from the group consisting of amylase, lipase and mixtures thereof.

* * * * *